US005385525A

United States Patent [19]

Davis

[11] Patent Number: 5,385,525

[45] Date of Patent: Jan. 31, 1995

[54] WALL MOUNTED SHOWER EXERCISE MACHINE

[76] Inventor: Robert A. Davis, P.O. Box 1038, Southwest Harbor, Me. 04679

[21] Appl. No.: 225,137

[22] Filed: Apr. 8, 1994

[51] Int. Cl.[6] ..... A63B 21/02

[52] U.S. Cl. ..... 482/121; 482/126; 482/129

[58] Field of Search ..... 482/87, 129, 35, 39, 482/904, 126, 121, 63, 116

[56] References Cited

U.S. PATENT DOCUMENTS

| | | | |
|---|---|---|---|
| 43,149 | 6/1864 | Wood | 482/129 |
| 254,108 | 2/1882 | Bryon, Jr. | 482/129 |
| 680,556 | 8/1901 | Wieland | 482/129 |
| 2,768,828 | 10/1956 | Pack | 482/35 |
| 4,402,504 | 9/1983 | Christian | 482/129 |
| 4,953,852 | 9/1990 | Donohue | 482/87 |
| 5,029,850 | 7/1991 | Van Straaten | 482/126 |
| 5,221,240 | 6/1993 | Mann et al. | 482/129 |

*Primary Examiner*—Stephen R. Crow
*Assistant Examiner*—Jerome Donnelly
*Attorney, Agent, or Firm*—Daniel H. Kane

[57] ABSTRACT

An exercise machine is constructed with an elongate rectangular framework having spaced apart vertical legs joined by a plurality of horizontal cross braces. Suction cup anchors are attached to the elongate rectangular framework approximately at the four corners and at midsections of the legs for anchoring the shower exercise machine to nonporous wall surfaces such as tile surfaces or other nonporous wall surfaces of a shower or bath. First and second stretchable resistance cords are anchored at one end to the rectangular framework at the midsection of the legs and terminate at the other ends in hand grips. The stretchable resistance cords pass through pulleys. Pulley supports are provided for supporting the pulleys at different locations on the rectangular framework for example at the top corners or the bottom corners of the rectangular framework for changing the direction of the handle grips and direction of stretching of the cords for exercising different muscles. The exercise machine can be disassembled into a smaller package for transport. A set of adhesively backed nonporous surface decals are provided for installing the exercise machine on a porous wall surface and for use of the exercise machine at any desired location.

11 Claims, 7 Drawing Sheets

WALL MOUNTED SHOWER EXERCISE MACHINE

TECHNICAL FIELD

This invention relates to a new fitness machine and workout system with resistance for toning muscles, warming up, and working out. The invention provides a new exercise system which permits warmup and workout in the shower as well as exercise use at other locations. The invention also provides an exercise machine which is easily disassembled into a small package for travel while permitting rapid assembly and installation on the wall of a shower or bathtub or other desired location.

BACKGROUND ART

A variety of exercise machines, muscle toning apparatuses, specialized training machines, and workout systems have been developed for use in gyms, weight rooms, and workout locations. However none of these exercise machines is adapted for installation and use in the shower or bath for exercising, muscle toning and working out under the shower as well as for installation and use at other locations.

OBJECTS OF THE INVENTION

It is therefore an object of the present invention to provide a new wall mounted exercise machine with resistance for toning muscles, warming up and working out at the same time as bathing under the shower. A feature of the invention is that the resistance afforded by the exercise machine can be flexibly located at different directions and angles for exercising and toning different muscles while taking a shower. The invention is also applicable for installation and use at other wall mounted locations selected by the user.

Another object of the invention is to provide an exercise machine which can be rapidly installed on a nonporous surface such as the surfaces of a shower or bath but which also can be wall mounted on other surfaces for installation and use at other locations. The invention also provides a method and apparatus or hardware for preparing porous wall surfaces to receive the exercise machine.

A further object of the invention is to provide such an exercise machine which can be rapidly disassembled and packaged in a small space for travel and transport for example in a standard size suitcase.

DISCLOSURE OF THE INVENTION

In order to accomplish these results the present invention provides a shower exercise machine in the configuration of an elongate rectangular framework having first and second spaced apart substantially vertical legs joined by a plurality of substantially horizontal cross braces. Cross braces are provided at least across the tops of the legs, the bottoms of the legs, and the midsections of the legs. According to the invention a plurality of suction cup anchors are attached to the elongate rectangular framework approximately at four corners of the framework and at the midsection of the legs for anchoring the exercise machine to the nonporous wall surface of a shower or bath. The suction cup anchors can of course also be applied to any nonporous wall surface locations prepared according to the invention to receive the suction cups and for exercising by the user at any desired wall location.

First and second stretchable resistance cords are provided with sufficient length to accommodate arm and leg exercise motion over the stretching distance of the cords. The first and second cords are anchored at one end to the rectangular framework substantially at the midsection of the respective legs. The cords terminate at the other ends respectively in first and second hand grips. The first and second cords pass through and around respective first and second pulleys.

Pulley supports are constructed for supporting the pulleys at different locations on the rectangular framework. Thus the pulley supports are constructed for supporting the pulleys approximately at respective corners of the rectangular framework. The pulleys can be placed for example at the corners at the top of the legs or the corners at the bottom of the legs of the rectangular framework for changing the direction of the handle grips and the direction of stretching of the cords for exercising different muscles.

In the preferred example, the rectangular framework is assembled from first and second rectangular frames having leg components on the sides of the frames extending beyond one end of the respective rectangular frames. The leg component extensions are used for joining the leg components together to form the legs of the larger elongate rectangular framework. A feature of the invention is that the rectangular frames are releasably joined at the leg components for disassembling the elongate rectangular framework into side by side rectangular frames of smaller dimension than the rectangular framework. The exercise machine can therefore be packed for example in a standard size suitcase with clothes and other gear for traveling.

According to the preferred embodiment the two rectangular frames to be assembled are constructed from plastic pipe joined at two of the corners by T joint plastic fittings and at the other two corners by L joint plastic fittings. The rectangular framework assembled from the two frames therefore includes substantially parallel vertical legs assembled from the leg components of the rectangular frames, a first cross brace joining the legs at the top, a second cross brace joining the legs at the bottom, and third and fourth spaced apart cross braces joining the legs at the midsection of the legs. The first and second cross braces are joined to the legs by L joint plastic fittings at the corners of the rectangular framework and the third and fourth cross braces are joined to the legs by T joint plastic fittings at the midsections of the legs.

According to other features of the preferred example the pulley supports are S hooks and the upper and lower corners of the rectangular framework are formed with drilled holes for inserting the S hooks. The stretchable resistance cords are anchored at respective ends to the rectangular framework substantially at the midsection of the respective legs by jamb hooks coupled to eye bolts at the midsection of the respective legs.

The invention also provides a method of preparing a porous wall to impart nonporous surface locations for receiving the suction cup anchors. The porous wall is coated at the surface locations of the suction cups with a nonporous resin or polymer which bonds to the porous surface, fills the pores, and provides a smooth non-porous surface at the suction cup locations. By way of example a suitable resin is polyurethane finish resin. In the preferred example for use on porous wall surfaces, nonporous, smooth, high gloss decals with adhesive backing are applied to the wall at the suction cup locations. The area of the adhesively backed nonporous decals is greater than the area of the suction cups to accommodate and retain the suction cup anchors at the decal locations on the wall. By use of such decals, the exercise machine can be mounted on substantially any wall surface for exercising at any location desired by the user. A further advantage of the adhesive backing decals is that they may be removable.

More generally, the invention provides a wall mounted exercise machine for warmup and workout incorporating the elongate rectangular framework. A plurality of wall anchors attached to the elongate framework approximately at the four corners of the framework and at the midsection of the legs anchor the wall mounted exercise machine to a wall. According to a preferred example the rectangular framework is constructed so that the vertical legs are spaced apart approximately 16 inches on center for anchoring the legs of the rectangular framework to studs in a wall of standard construction if a semi-permanent installation is preferred by the user.

Other objects, features and advantages of the invention are apparent in the following specification and accompanying drawings.

DESCRIPTION OF PREFERRED EXAMPLE EMBODIMENTS AND BEST MODE OF THE INVENTION

Figure 1:
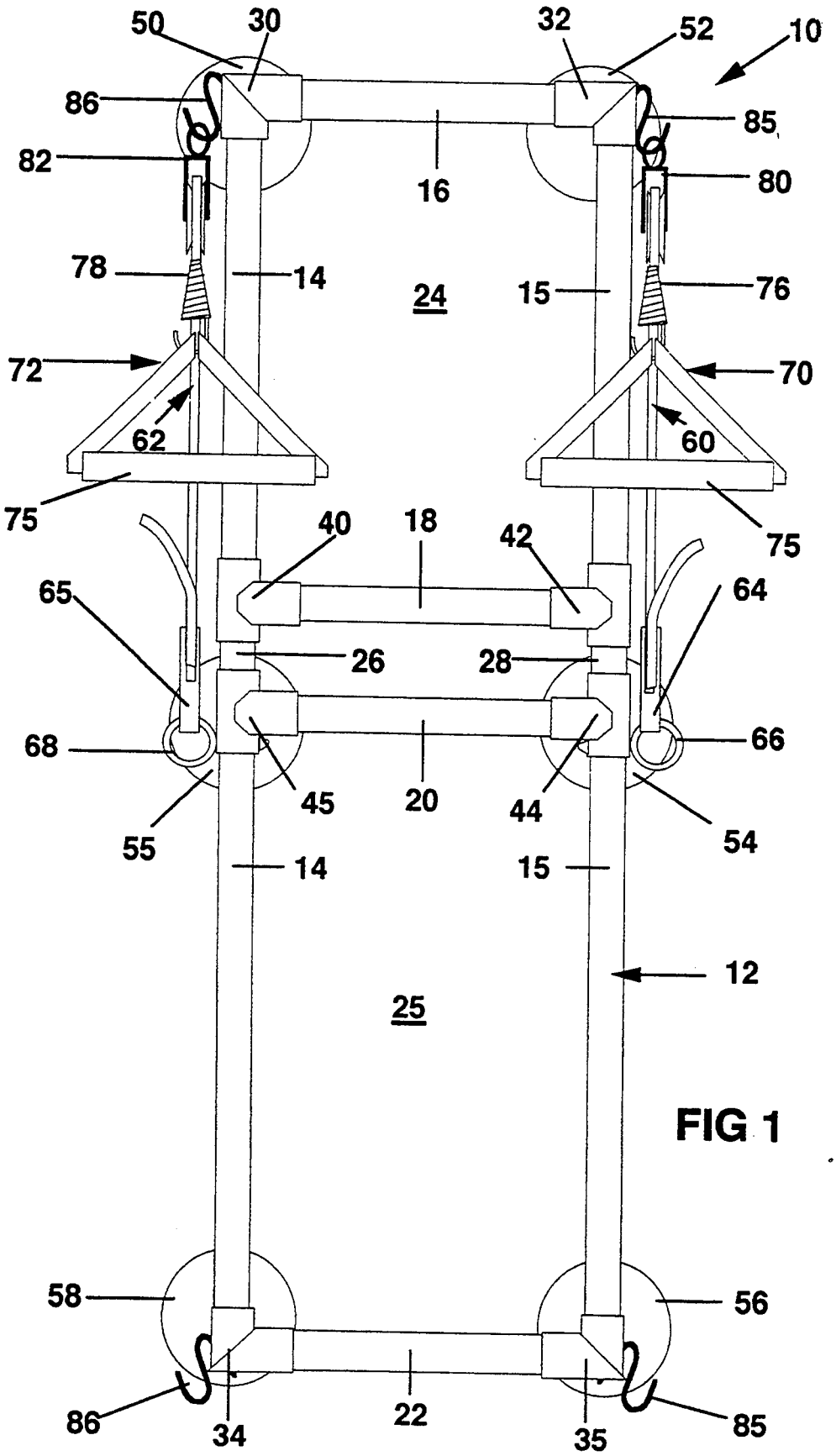
FIG. 1 is a plan view of the exercise machine mounted on a shower wall from the perspective of a user approaching the exercise machine and with the stretchable resistance cords and hand grips mounted by pulley supports at a first location.

As shown in FIGS. 1 through 5, the shower exercise machine 10 is constructed with an elongate rectangular framework 12 having substantially parallel and vertical legs 14,15 joined by horizontal cross braces 16,18,20, and 22. The cross braces include a top cross brace 16, bottom cross brace 22, and midsection cross braces 18,20.

The elongate framework 12 is actually assembled from two rectangular frames 24 and 25 with leg components that are assembled together to form the legs 14,15. To this end the leg components of the respective frames 24,25 extend beyond one end of the frames for joining together at leg sections 26,28.

By way of example the rectangular framework 12 and rectangular frames 24,25 can be assembled from Schedule 40 PVC plastic pipe. At upper corners 30,32 of the elongate rectangular framework 12 the top cross brace 16 is joined to legs 14,15 by L joint plastic fittings. Similarly at the lower corners 34,35 the bottom cross brace 22 is joined to the legs 14,15 by L joint plastic fittings. At the midsection of legs 14,15 the midsection cross braces 18,20 are joined to the legs 14,15 by T joints 40,42,44, and 45. The T joints extend beyond the ends of the rectangular frames 24,25 providing for assembly of the frames together by leg sections 26,28 to form the elongate rectangular framework 12.

For securing the rectangular framework 12 to a nonporous surface such as a tiled wall of a shower or bath suction cup anchors 50,52,54,55,56, and 58 are screwed or bolted to the rectangular framework 12 at strategic locations for bearing the forces exerted on the exercise machine. Thus, suction cup anchors 50,52 are secured to the rectangular framework adjacent to the upper corners 30,32 while suction cup anchors 56,58 are secured at the lower corners 35,34. Suction cup anchors 54,55 are secured to the rectangular framework 12 at the midsection of legs 14,15 and in this example below the T joints 44,45 at midsection brace 20. The suction cup anchors can be used at any nonporous wall locations desired by the user or wall surfaces prepared as hereafter described with nonporous wall surface locations.

In the preferred example the legs 14,15 are spaced apart by the cross braces approximately 16 inches on center so that the suction cups 50,52,54,55,56, and 58 fall within wall tiles without crossing grout lines for standard 4 inch wall tiles. Alternatively, substantially any wall surface including porous walls can be prepared to receive the suction cups as hereafter described.

For the exercise component of the machine, elastic stretchable resistance cords 60,62 are provided with sufficient length to accommodate arm and leg and other exercise motions over the stretchable length of the cords 60,62. Such stretchable resistance cords are provided for example by polypropylene covered rubber elastic cords and are used for pull exercisers. At one end, the cords 60,62 are anchored to the rectangular framework 12 at jamb cleats or jamb hooks 64,65. The jamb hooks 64,65 are in turn anchored to the rectangular framework 12 by ring bolts or eye bolts 66,68. The other ends of the stretchable resistance cords 60,62 are connected to hand grips 70,72 for pulling exercises. As shown in the exploded view of FIG. 5 the hand grips 70 and 72 can be assembled from a variety of materials such as a triangular steel or aluminum frame 74 or even a rubber tie down, and a sleeve 75 such as ¾ inch inner diameter plastic pipe suitable for gripping by the hand. The hand grips 70,72 are joined to the resistance cords 60,62 by hooks 76,78.

Figure 2:
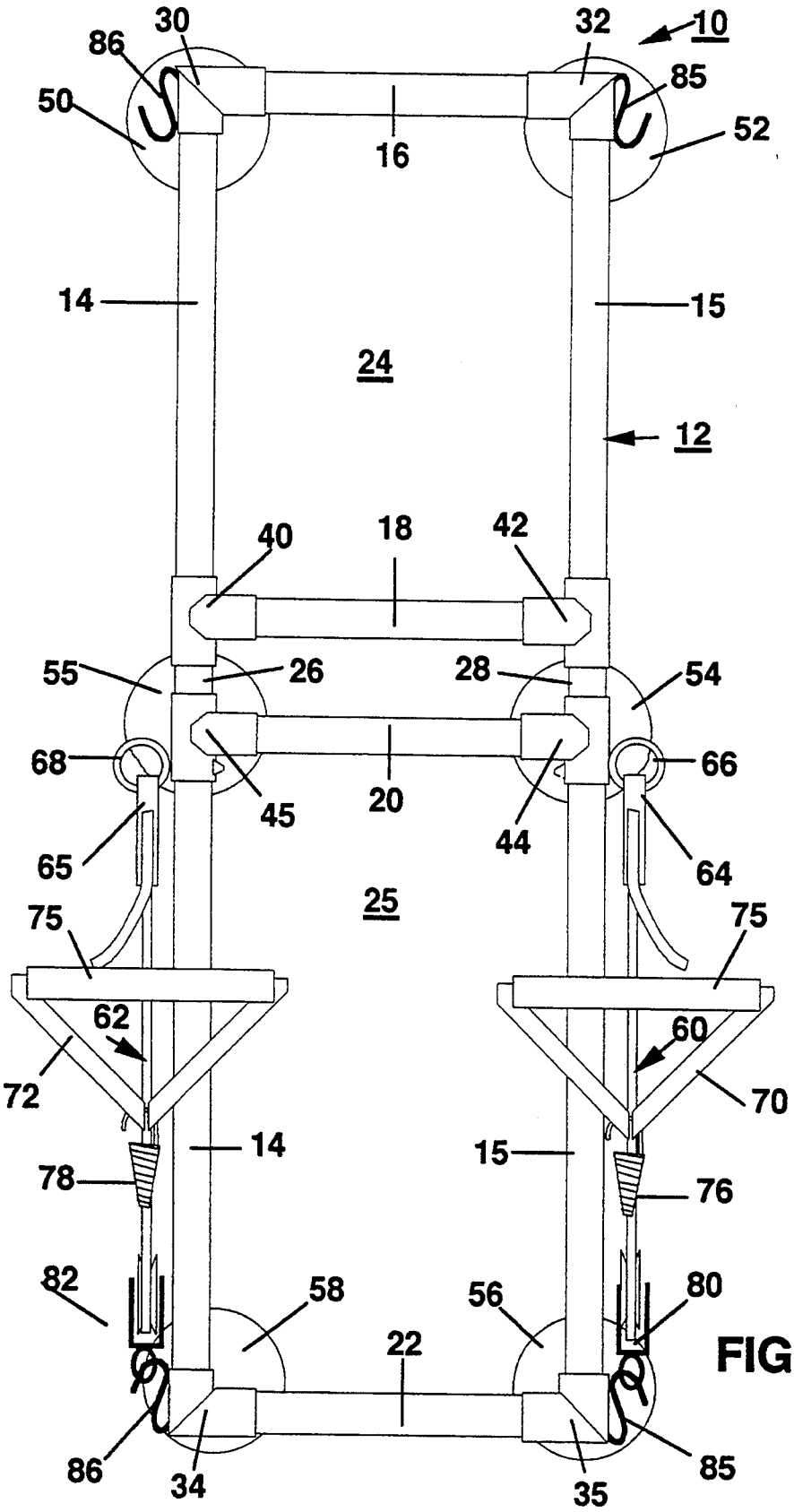
FIG. 2 is another plan view of the exercise machine with the stretchable resistance cords and hand grips mounted by pulley supports at a second location for exercising different muscles.
Figure 3:
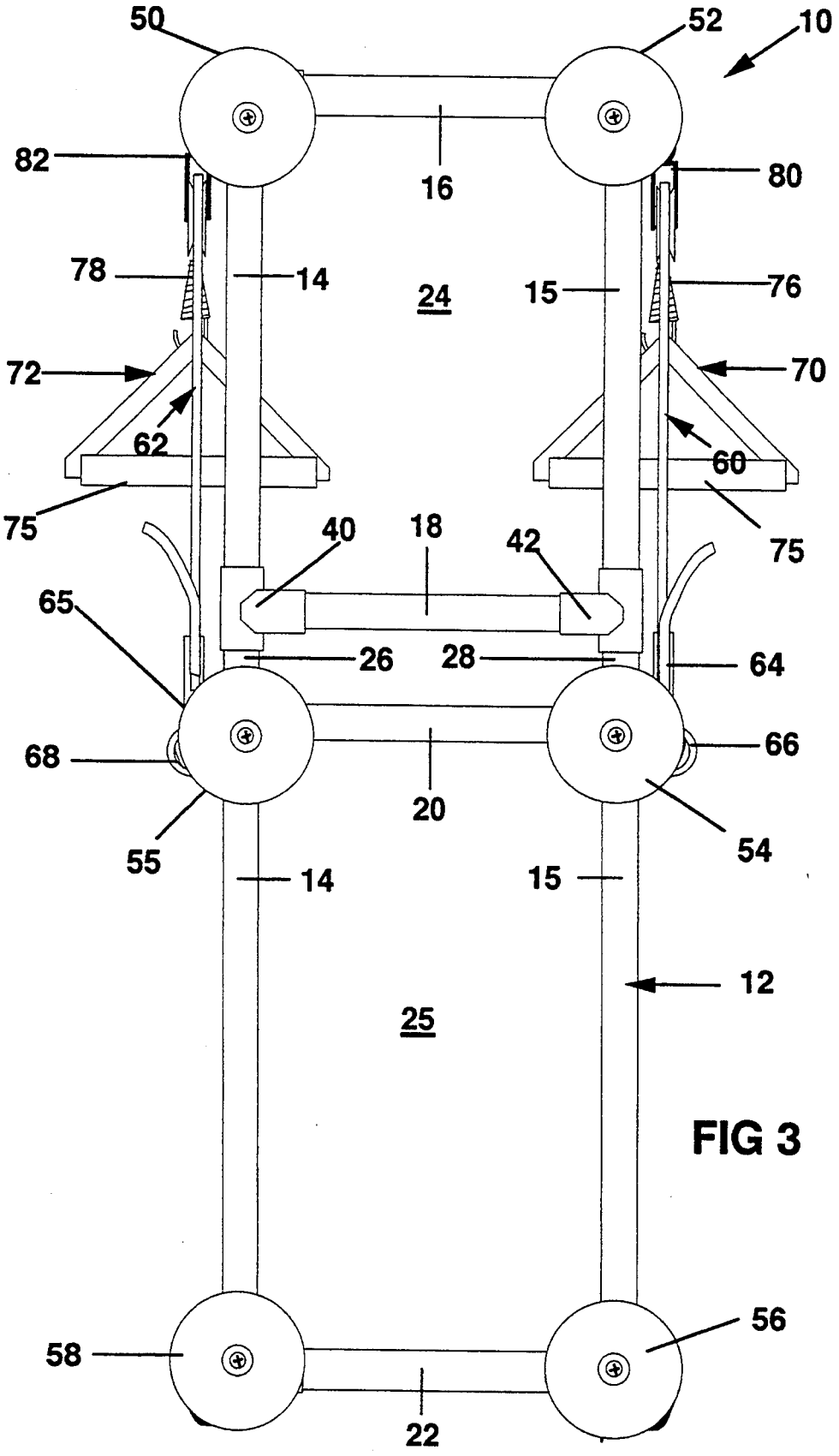
FIG. 3 is a plan view from the wall side of the exercise machine showing the suction cups.
Figure 4:
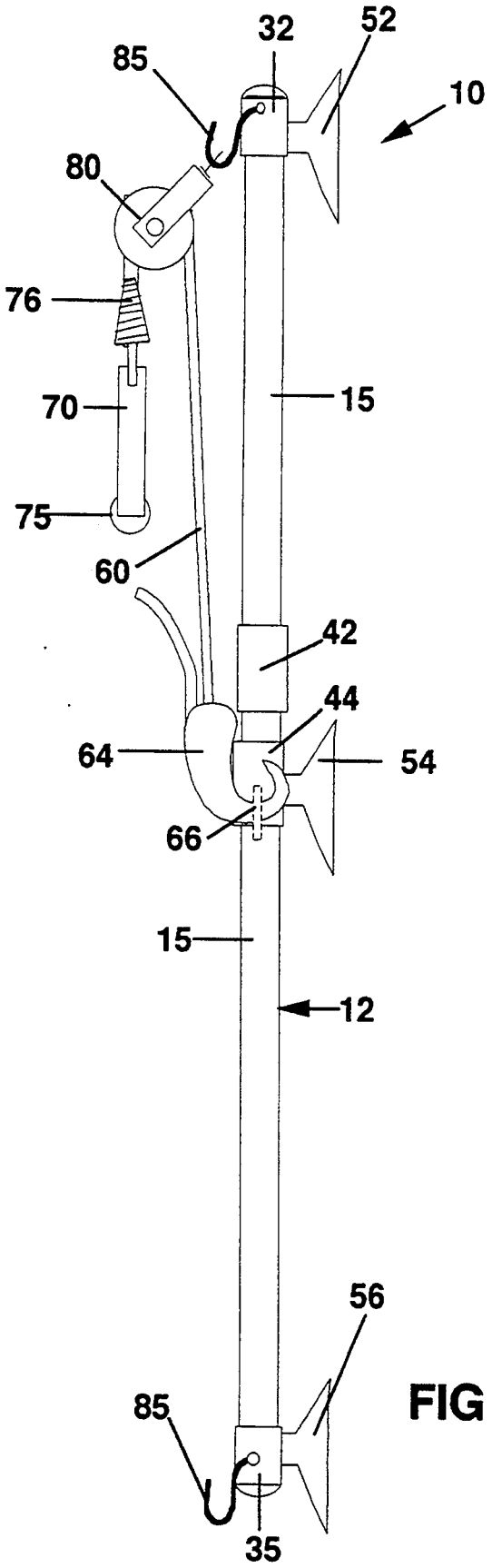
FIG. 4 is a side view of the exercise machine.
Figure 5:
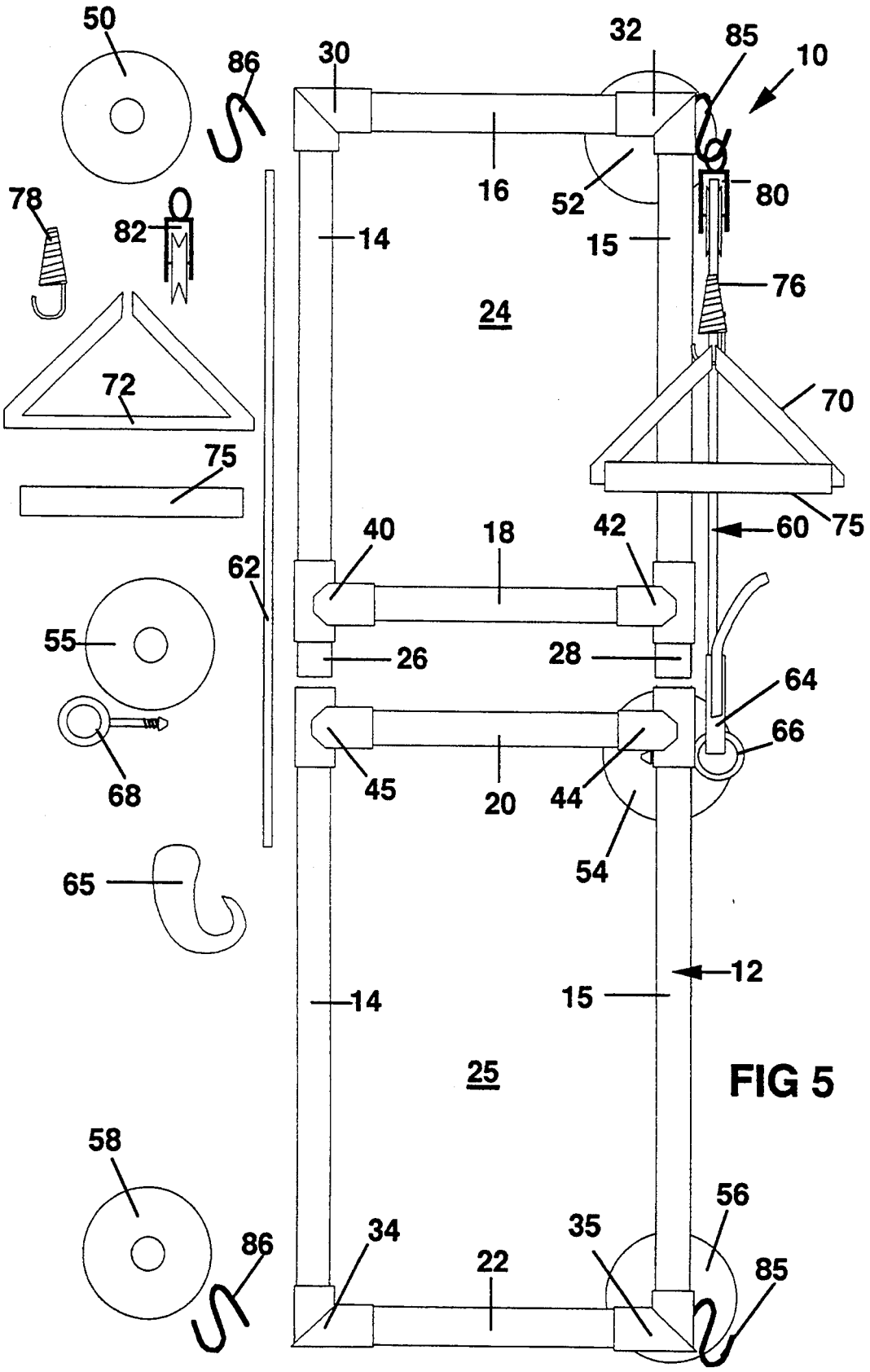
FIG. 5 is a partially exploded plan view showing the parts of the exercise machine.

The stretchable resistance cords 60,62 in turn pass through low friction pulleys 80,82 with a swivel mount 84. The pulleys 80,82 can be supported on the elongate rectangular framework 12 at different locations for providing a variety of exercise angles for pulling exercises with different muscles. Pulley supports or anchors are provided by S hooks 85,86 which can be hooked to the elongate rectangular framework 12 at different locations. The S hooks 85,86 can be secured to the rectangular framework 12 at different locations through holes drilled in the plastic pipe. As shown in FIGS. 1 and 2 the holes are drilled through the L joints at the corners 30,32,34 and 35 so that the pulleys 80,82 can be secured to the rectangular framework 12 either at the top corners 30,32 as shown in FIG. 1 or the bottom corners 34,35 as shown in FIG. 2.

Importantly, the force points on the stretchable resistance cords 60,62 are located adjacent to suction cup anchors for bearing the forces on the rectangular framework. Thus, the anchored ends of the stretchable resistance cords 60,62 are anchored by the jamb hooks 64,65 and eye bolts 66,68 at the midsection suction cup anchors 54,55. As shown in FIG. 1 the pulleys 80,82 for reversing the direction of pull are anchored by S hooks 85,86 at the suction cup anchors 50,52 at upper corners 30,32. As shown in FIG. 2, the pulley support S hooks anchor the pulleys 80,82 at the suction cup anchors 56,58 at the lower corners 35,34. Advantageously, the forces applied by the exercise cords on the suction cups are primarily upward and downward rather than outward or away from the wall for greater holding ability.

By way of example the elongate rectangular framework can be assembled from the Schedule 40 PVC plastic pipe having a ¾ inch inner diameter and an overall width of 17 inches so that the legs 14,15 are approximately 16 inches on center. The rectangular framework is constructed with an overall length or height of 4 feet which can be disassembled into two rectangular frames 24,25 having lengths approximately 26 inches and 23 inches when disassembled. A suitable elastic resistance cord is typically ⅜ inch diameter polypropylene covered rubber elastic cord suitable for pull exercises. The suction cups are selected to be approximately 2.5 inches in diameter.

A variety of pulleys can be used for changing the direction of the stretchable resistance cords 60,62, for example 2½ inch diameter low friction pulleys. Rotating pulleys are not essential and any direction changing low friction surface can be used instead of a rotating surface. As used in this specification and following claims, the term "pulley" is therefore intended to encompass not only rotating pulley surfaces but any direction changing device whether using a rotating surface or a stationary low friction surface.

With components of these dimensions, the shower exercise machine 10 occupies very little space in a shower stall or shower bath area and extends only 2 inches from the wall. The shower exercise machine therefore does not interfere in ordinary shower activities. Similarly, the exercise machine occupies very little room space at other wall mounted locations.

The exercise machine of the present invention is of course not limited to use in the bathroom or shower and as hereafter described is applicable for exercise at any locations desired by the user. Furthermore for use in the bath or shower, the exercise machine can be used with or without the shower on or with or without bathing. Unlike other exercise systems, however, the exercise machine 10 can be used in the shower while showering or bathing.

Figure 6:
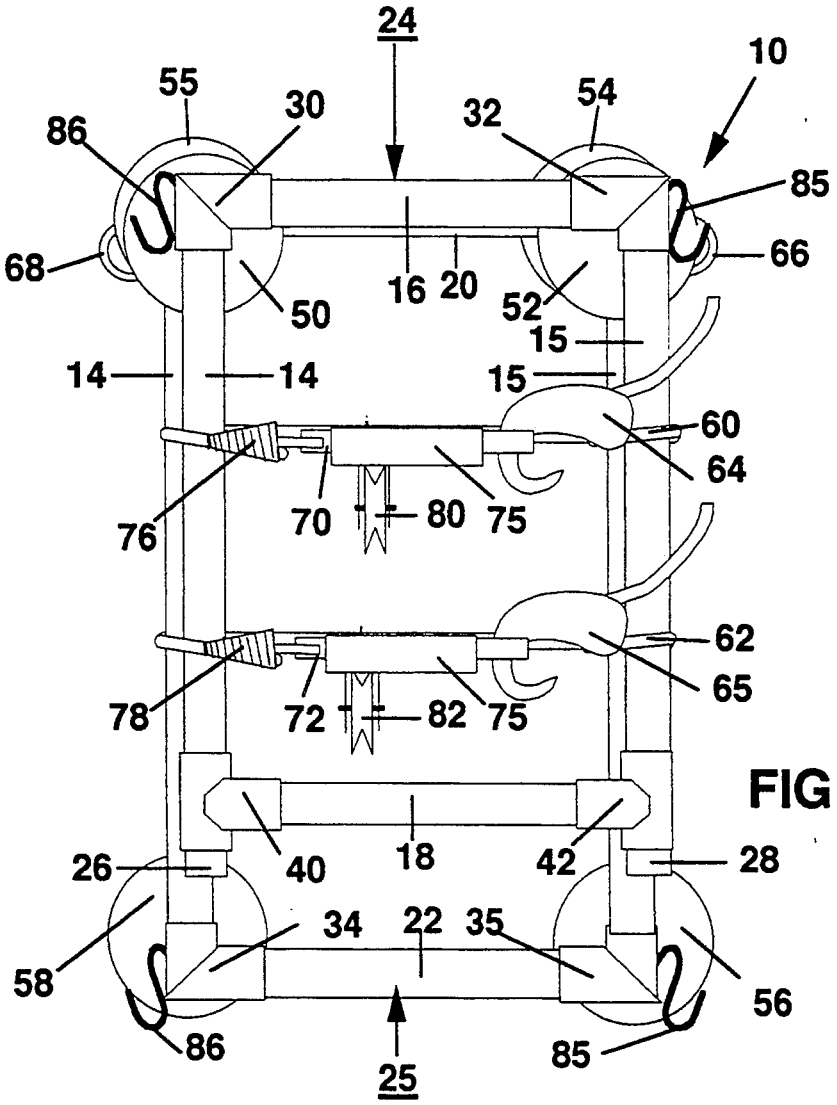
FIG. 6 is a plan view of the exercise machine disassembled and packaged in a smaller dimension for travel.

A further advantage of the exercise machine 10 is illustrated in FIG. 6. As shown in FIG. 6 the exercise machine has been disassembled so that the rectangular frames 24,25 are placed one on top of the other reducing the area of the exercise machine approximately in half. The pulleys 80,82 can be removed from the S hooks 85,86 and the jamb hooks 64,65 can be removed from the eye bolts 66,68 so that the stretchable resistance cords 60,62 can be used to tie the frames 24,25 together in a small package. In this configuration the disassembled exercise machine 10 can fit inside an ordinary suitcase with clothes and other gear for convenient transport.

For use of the exercise machine 10 on porous wall surfaces, the invention provides a method and hardware for preparing the porous wall surface to receive the suction cup anchors. According to one example, areas of the wall surface at the suction cup locations are painted or treated with a polymer resin that bonds to the porous surface and forms smooth nonporous surface locations to receive the suction cups. A suitable resin finish is, for example, polyurethane finish resin and multiple coats may be applied. The exercise machine of the present invention can therefore be used at a variety of locations not limited to the bathroom or shower, and is adaptable for exercising at any desired location by the user.

Figure 7:
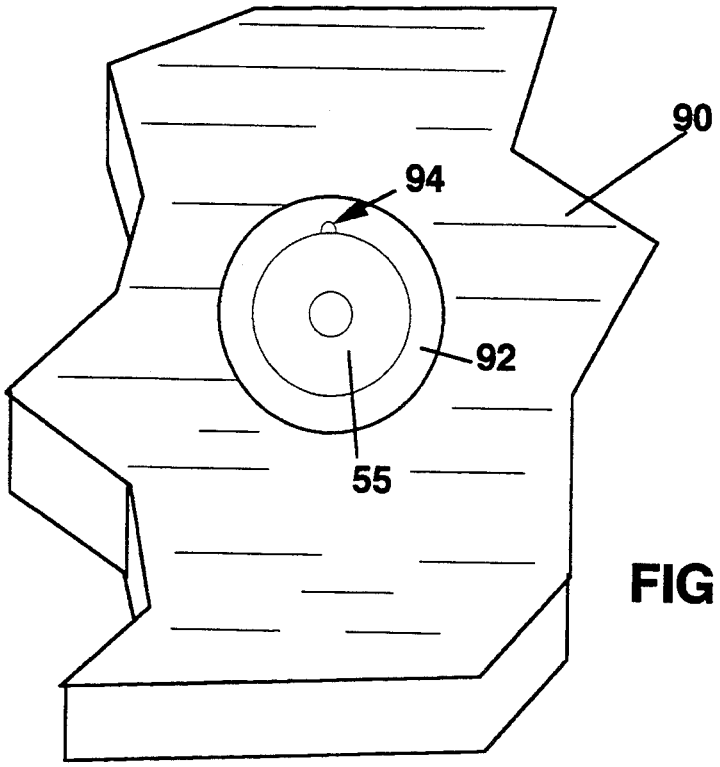
FIG. 7 is a fragmentary plan view of a porous wall surface prepared for receiving the suction cup anchors of the exercise machine.

In the preferred example for porous walls, the porous wall 90, shown in FIG. 7, is prepared by applying onto the wall at the suction cup locations, decals 92 with adhesive backing. Appropriate decals have smooth, high gloss, nonporous surfaces for retaining the suction cups and are formed with a strong adhesive backing. Such decals are available for example from Duro Decal Company, Chicago, Ill. 60626, Product No. 4205. An advantage of the decals is that they are also removable from the wall surface. As shown in FIG. 7, the suction cups 55 are provided with raised tabs 94 for east in removing the suction cup from the decal nonporous surface.

According to another embodiment of the invention, the suction cup anchors 50,52,54,55,56, and 58 can be removed from the rectangular framework 12 and the framework can be anchored for example to a wood wall by screws through holes drilled through the L joints and T joints at approximately the same locations as the suction cup anchors. This may be desirable for semi-permanent installations. Whichever wall mounting is used, the configuration of the rectangular framework and the location of the wall mounting anchors distributes the forces applied during pulling exercises across the framework and in particular to the locations of the wall mounting anchors.

While the invention has been described with reference to particular example embodiments it is intended to cover all modifications and equivalents within the scope of the following claims.

I claim:

1. An exercise machine for warmup and workout in the shower and at other locations selected by the user comprising:

an elongate rectangular framework having first and second spaced apart substantially vertical legs joined by a plurality of substantially horizontal cross braces, said cross braces comprising at least one cross brace each at the top of the legs, bottom of the legs, and midsection of the legs;

a plurality of suction cup anchors attached to the elongate rectangular framework approximately at four corners of the framework and at the midsection of the legs for anchoring the shower exercise machine to nonporous wall surfaces;

first and second stretchable resistance cords having sufficient length to accommodate arm exercise motion over the stretching distance of the cords, said first and second cords being anchored at one end to the rectangular framework substantially at the midsection of the respective legs, said cords terminating at the other ends respectively in first and second hand grips;

first and second pulleys, said first and second cords passing through and around the respective first and second pulleys;

and a plurality of pulley supports constructed for supporting the pulleys at different locations on the rectangular framework, said pulley supports comprising pulley supports constructed for supporting the pulleys approximately at respective corners of the rectangular framework including the corners at the top of the legs or the corners at the bottom of the legs of the rectangular framework for changing the direction of the handle grips and the direction of stretching of the cords for exercising different muscles.

2. The exercise machine of claim 1 wherein the rectangular framework comprises first and second rectangular frames having leg components on the sides of the frames extending beyond one end of the respective rectangular frames for joining together the leg components to form the legs of the rectangular framework, said rectangular frames being releasably joined at the leg components for disassembling the elongate rectangular framework into side by side rectangular frames of smaller dimension than the rectangular framework and for packing in a smaller space.

3. The exercise frame of claim 2 wherein the rectangular frames are constructed from plastic pipe joined at two of the corners by T joint plastic fittings and at the other two corners by L joint plastic fittings.

4. The exercise machine of claim 3 wherein the pulley supports comprise S hooks and wherein the upper and lower corners of the rectangular framework are formed with drilled holes for inserting the S hooks.

5. The exercise machine of claim 1 wherein the ends of the first and second stretchable resistant cords are anchored at respective ends to the rectangular framework substantially at the midsection of the respective legs by jamb hooks coupled to the midsection of the respective legs.

6. The exercise machine of claim 2 wherein the rectangular framework assembled from the rectangular frames comprises substantially parallel vertical legs assembled from the leg components of the rectangular frames, a first cross brace joining the legs at the top, a second cross brace joining the legs at the bottom, and third and fourth spaced apart cross braces joining the legs at the midsection of the legs.

7. The exercise machine of claim 6 wherein the rectangular frames are constructed from plastic pipe, wherein the first and second cross braces are joined to the legs by L joint plastic fittings, and wherein the third and fourth cross braces are joined to the legs by T joint plastic fittings.

8. The exercise machine of claim 3 wherein the rectangular frames comprising the rectangular framework are dimensioned so that the disassembled rectangular framework of side by side rectangular frames can fit in a standard size suitcase for travel.

9. The exercise machine of claim 3 wherein the rectangular framework comprises plastic pipe joined by L joints at the top and bottom corners of the rectangular framework and T joints at the midsections of the legs for joining the rectangular frames together at the midsection of the legs of the rectangular framework.

10. The exercise machine of claim 3 wherein the elongate rectangular framework is constructed with the vertical legs spaced apart substantially 16 inches on center so that the suction cup anchors fall in the middle of tiles for a shower wall or bathtub wall tiled with standard 4 inch tiles.

11. The exercise machine of claim 1 comprising a set of adhesively backed decals having smooth nonporous surfaces for application on porous walls at the suction cup anchor locations for receiving and holding the suction cup anchors.

* * * * *